US009901757B2

(12) United States Patent
Paglioli

(10) Patent No.: US 9,901,757 B2
(45) Date of Patent: Feb. 27, 2018

(54) SAFETY DEVICE

(75) Inventor: Carlo Paglioli, Cisano Bergamasco (IT)

(73) Assignee: ALUDESIGN S.P.A., Cisano Bergamasco (BG) (IT)

( * ) Notice: Subject to any disclaimer, the term of this patent is extended or adjusted under 35 U.S.C. 154(b) by 0 days.

(21) Appl. No.: 13/383,080

(22) PCT Filed: Jul. 1, 2010

(86) PCT No.: PCT/IB2010/001614

§ 371 (c)(1),
(2), (4) Date: Jan. 27, 2012

(87) PCT Pub. No.: WO2011/007225

PCT Pub. Date: Jan. 20, 2011

(65) Prior Publication Data

US 2012/0111665 A1 May 10, 2012

(30) Foreign Application Priority Data

Jul. 15, 2009 (IT) ..... MI2009A1259

(51) Int. Cl.
*A62B 1/14* (2006.01)
*A63B 29/02* (2006.01)

(52) U.S. Cl.
CPC ..... *A62B 1/14* (2013.01); *A63B 29/02* (2013.01)

(58) Field of Classification Search
CPC .... A62B 1/14; A62B 1/06; A62B 1/20; A62B 35/0081; A62B 35/0093; A62B 35/005; A62B 35/04; A63B 29/02
USPC ..... 182/5, 6, 7; 188/65.2–65.4, 65.5; 24/136 R
See application file for complete search history.

(56) References Cited

U.S. PATENT DOCUMENTS 1,021,986 A * 4/1912 Johnson ..... 24/136 R
4,542,884 A * 9/1985 Dodge, Jr. ..... 254/391
4,667,772 A * 5/1987 Kammerer ..... A62B 35/04 182/6
4,678,059 A * 7/1987 Bowker ..... 182/5
5,850,890 A * 12/1998 Couttet ..... A62B 1/04 182/191

(Continued)

FOREIGN PATENT DOCUMENTS

DE 3546181 A1 * 3/1987 ..... A62B 1/04
WO 2006/035138 A1 4/2006

OTHER PUBLICATIONS

Definition of 'between' found in Action Collins English Dictionary—Complete and Unabridged © HarperCollins Publishers 1991, 1994, 1998, 2000, 2003.*

(Continued)

*Primary Examiner* — Daniel P Cahn
(74) *Attorney, Agent, or Firm* — Lucas & Mercanti, LLP

(57) ABSTRACT

A belaying device for blocking a rope. The device has a main body formed by two flat plates in parallel and constrained one to each other with a plurality of spacing pins. The rope is inserted inside the device body. A carabiner is attached to the main body by passing through an opening on the device body. The carabiner allows the belaying device to be constrained to an user, or an anchorage point, and it is movable at the opening between a non-blocking position of the rope, that is the condition of normal use, and an emergency position wherein the rope is blocked, and vice versa.

10 Claims, 3 Drawing Sheets

(56) References Cited

U.S. PATENT DOCUMENTS

| | | | | |
|---|---|---|---|---|
| 7,108,099 | B2 * | 9/2006 | Ador | 182/5 |
| 7,353,910 | B2 * | 4/2008 | Klingler | 182/5 |
| 8,312,965 | B2 * | 11/2012 | Petzl et al. | 182/5 |
| 2002/0084139 | A1 * | 7/2002 | Richard et al. | 182/5 |
| 2003/0029672 | A1 * | 2/2003 | Argoud | A62B 35/0056 182/36 |
| 2004/0016597 | A1 * | 1/2004 | Gregory | 182/5 |
| 2006/0283662 | A1 * | 12/2006 | Martin | A62B 1/14 182/8 |
| 2007/0119653 | A1 * | 5/2007 | Brown | A62B 1/14 182/36 |
| 2007/0205048 | A1 * | 9/2007 | Klingler | 182/5 |
| 2007/0215411 | A1 * | 9/2007 | Petzl et al. | 182/193 |
| 2007/0261915 | A1 * | 11/2007 | Auston | A62B 35/0056 182/11 |
| 2008/0005876 | A1 * | 1/2008 | Christianson | 24/600.1 |
| 2008/0245611 | A1 * | 10/2008 | Klingler | A62B 1/14 182/6 |
| 2009/0026011 | A1 * | 1/2009 | Petzl et al. | 182/5 |
| 2010/0031479 | A1 * | 2/2010 | Apicella | A62B 1/14 24/129 R |
| 2010/0122873 | A1 * | 5/2010 | Plaze | A62B 1/06 182/193 |
| 2011/0114415 | A1 * | 5/2011 | Chu | 182/5 |
| 2011/0186388 | A1 * | 8/2011 | Sudale | A62B 35/0081 188/65.2 |
| 2011/0284323 | A1 * | 11/2011 | Ayre | A62B 1/14 182/5 |
| 2014/0174850 | A1 * | 6/2014 | Paglioli | A62B 1/14 182/5 |
| 2016/0130875 | A1 * | 5/2016 | Hwang | E06C 7/186 182/5 |

OTHER PUBLICATIONS

Definition of 'tooth' found in Action The American Heritage® Dictionary of the English Language, Fourth Edition copyright © 2000 by Houghton Mifflin Company. Updated in 2009. Published by Houghton Mifflin Company. All rights reserved.*

* cited by examiner 11
2
3
5
12
45
6
50
4
22
8A
8B
20A
20C
8
20
8A
20B
30
21
7
13
1
9

SAFETY DEVICE

CROSS-REFERENCE TO RELATED APPLICATIONS

This application is a 371 of PCT/IB2010/001614, filed Jul. 1, 2010, which claims the benefit of Italian Patent Application No. MI2009A001259, filed Jul. 15, 2009, the contents of each of which are incorporated herein by reference.

FIELD OF THE INVENTION

The present invention refers to a belaying device for regulating and blocking a rope running inside the device.

With the term "belaying device", it is intended a security device, mainly used in the climbing equipment and not only, whereby a first climber controls and blocks the restraining rope used for belaying a second climber.

These devices, known in the climbing field with the term "belay device", may be used both in the outdoor climb and in the practice walls and allow, in case of emergency, to assure the climber security, blocking the restraining rope to which he/she is belayed, thereby avoiding the fall thereof.

In fact, such devices are usually used for belaying a climber climbing a wall to a companion on the ground, in the field said "belayer", which avoids the free fall of the climber he is belaying by means of the belaying device, in case wherein during the ascent the climber would make a mistake with the subsequent loss of the secure handhold.

Such a technique is known as "belaying the lead climber", wherein the lead climber approaching the climb is aided and belayed to a companion on the ground, exactly the belayer, by the belaying device, that in case of emergency allows to block the restraining rope constrained to the climber, the latter having constrained the rope to one or more ring present on the climbing wall while proceeding little by little on the ascent.

Further, other belaying devices are known taking advantage of the chance of blocking the restraining rope in case of emergency, particularly the belayer may also perform his function when on the climbing wall.

For example, the devices may be used for belaying the second climber. In this case the lead climber on the climbing wall acts as a belayer and by the belaying device he controls the restraining rope to which a second climber, climbing the wall below him, is belayed. In case wherein the second climber looses the handhold, the belaying device constrained to the upper climber on the climbing wall allows to block the restraining rope and thereby avoids the companion fall.

Further, it is known how to use such devices as descender devices, that is to say for descending a previously climbed wall. In fact the climber, bringing the device constrained thereto, takes advantage of the belaying device capacity of blocking the running inside rope and then regulating, in case with convenient means the device is provided with, or simply manually, the descending speed changing the friction the device is exercising on the rope.

KNOWN ART DESCRIPTION

The belaying devices known in the art regulate the running of the rope and block it by means of a braking action, typically generating friction on the restraining rope.

By doing so it is possible to regulate the running, slow down or block the running of the rope, thereby avoiding the fall of the climber to be belayed.

Manual or semiautomatic devices are known, the latter, in case of emergency and then after the sudden tensioning of the rope because of the climber fall, automatically snap in the emergency position wherein the rope is blocked.

On the contrary, in the manual devices, in case of fall, the person having constrained therewith the device for belaying the companion on the climbing wall, has to manually move the restraining rope in the position wherein the device could slow down the running thereof and causing the block.

For example, the manual belaying device DOBLE V-ROW, commercialized by the Aludesign SpA company, is provided with a spout, conveniently shaped, having a housing wherein the rope is forced to pass in case of climber fall. The particular housing shape allows to apply friction on the rope, thereby limiting the force to be applied by the hand of person securing the falling companion for blocking the rope.

This belaying device type, although it is very cheap, provides a security level and blocking efficiency of the rope, depending on the experience and the skills of the person using the device, the belayer securing the companion. Further, also after the blocking position of the rope is reached, the user has to firmly keep in hand the restraining rope avoiding the latter from moving from the housing causing the blocking thereof by friction.

A semiautomatic, or self-braking, belaying device is the GRI-GRI model commercialized by the Petzl company.

Such a device is provided with an eccentric cam around which the restraining rope is passed. The cam is rotatably constrained to the device structure in such a way that, in case of emergency, when the climber to be belayed falls, the restraining rope tension will determine the cam rotation into the blocking position. In such a position, the cam tightens the restraining rope between itself and a fixed surface of the device structure. The device in provided as well with a handle allowing, when the blocking position of the rope is reached, to regulate the braking level inducing a little cam rotation in an opposite direction relatively to that allowing the rope to be tightened for blocking thereof. The handle is operated, for example, when the device is used as a descender, for regulating the descending speed partially blocking the rope.

The belaying device just described, and generally of the semiautomatic type, allows a higher security level relatively to the manually type, as the reaching of the blocking position of the rope happens automatically because of the restraining rope tension caused by the climber weight falling down.

Nevertheless, both the manual and automatic devices suffer the problem that, for guaranteeing an effective operation, the person using the device for belaying another climber has to maintain the rope in a predetermined position.

In fact, both the ends of the rope, coming in and out the device, have to be maintained in the correct position relatively to the device itself, for avoiding any problem in reaching the blocking position of the rope.

Further, the automatic devices are not particularly reliable during the handle activation when it is desired to partially release to rope.

OBJECTS OF THE INVENTION

Object of the present invention is to provide a belaying device assuring a high reliability level in blocking the restraining rope in every using condition and, in the meanwhile, having controlled dimensions and weight.

Particularly, the device according to the present invention is of the manual or self-braking type, and allows the automatic blocking of the rope after a sudden tension increase, caused by the belayed climber fall and the user (belayer) holding in one hand the free end of the rope.

Further object of the present belaying device is to get over the problems of the semiautomatic devices known in the art, and particularly to improve the security and reliability both in blocking the rope, and in its following partial release, for example when it is desired to give some rope to the belayed climber, or when the device is used as a descender.

Further, it is an object of the present invention to provide a belaying device able to aid the blocking of the rope also when the user inadvertently inserts the rope improperly.

A further object of the present invention is to provide a belaying device for carrying out the blocking of the rope.

SUMMARY OF THE INVENTION

It is described a belaying device for blocking a rope according to the present invention, comprising a main body formed by two flat plates constrained one to each other preferably according to two parallel planes by means of a plurality of constraining means, preferably composed of four spacing pins.

The rope is inserted inside the device body further comprising a carabiner attached to the main body passing through an opening on the device body.

The carabiner allows the belaying device to be constrained to an user, and it is movable at the opening between a non-blocking position of the rope, that is the condition of normal use, and an emergency position wherein the rope is blocked, and vice versa.

The opening outline is separated by at least one projecting tooth in a first opening portion and in a second opening portion, when the carabiner is disposed at the first portion the device is in the non-blocking position of the rope, whereas when the carabiner is disposed at the second portion the device is in the emergency position wherein the rope is blocked.

The device comprises, as well, means for preventing the accidental movement of the carabiner along the opening, such means including preferably a mobile lever disposed by a spring in a contrapposed position respect to the tooth the opening outline is provided with. For this reason, the mobile lever prevents the accidental movement of the carabiner from the first portion of the opening to the second portion of the opening, and vice versa.

For realizing the rope blocking, in the emergency position, the device comprises at least one contrast element aiding with the carabiner to generate the needed friction.

In fact, when the carabiner is disposed at the second opening portion, the rope is blocked because of the friction between the carabiner and the contrast element.

The particular shape of the opening outline on the plates defining the device body, and particularly the presence of a projecting tooth, allows to prevent the device from reaching the blocking position of the rope, or the emergency position, during the normal operations, in a completely accidental and unwanted way.

In fact, the mobile lever the device is provided with, prevents the carabiner from moving along the opening, removing the risk of an accidental passing from the non-blocking position of the rope to the emergency position wherein the rope is blocked, and vice versa.

Further, as mentioned, the present belaying device may also act as a descender assuring, also in this using way, high reliability and security.

Contrary to the traditional automatic belaying devices, there are not handles, or similar means, designed for the blocking regulation of the rope, for example during the wall descending. In fact, the partial release of the rope happens only moving by hand the device body, thereby avoiding problems in activation, for example by an handle.

BRIEF DESCRIPTION OF THE DRAWINGS

Further characteristics and advantages of the present invention will be more evident in the following description, for illustrative purposes referring to the attached figures, wherein.

DESCRIPTION OF THE PREFERRED EMBODIMENTS

Figure 1:
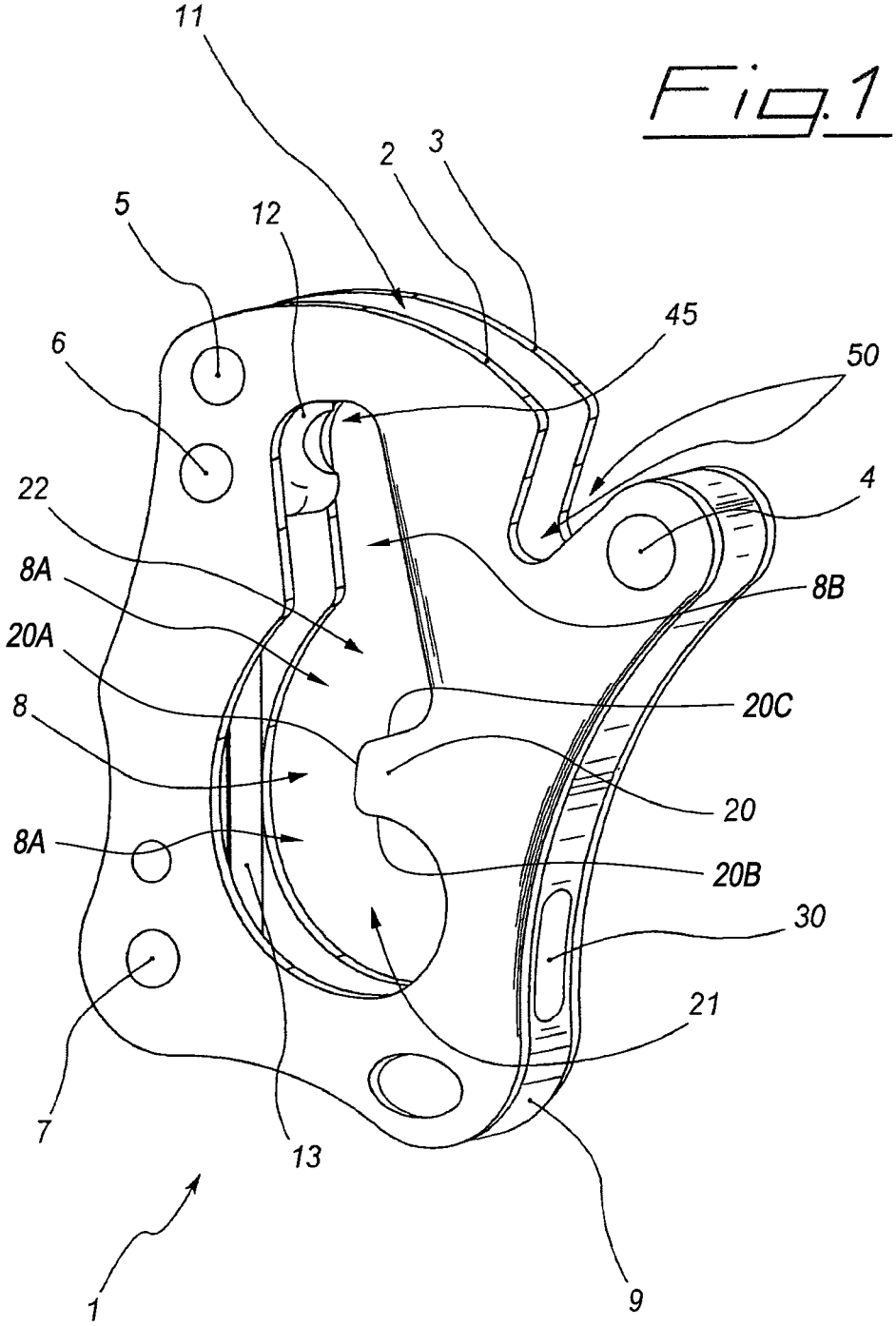
FIG. 1 is a perspective view of the belaying device according to the present invention.

As can be seen referring to FIG. 1, the belaying device in its preferred embodiment herein illustrated, comprises a main body 1 composed of two flat plates 2 and 3 constrained one to each other by a plurality of constraining means 4-7.

More in detail, the flat planes 2 and 3 are equal one to each other and are realized in a metallic material having high mechanical characteristics and reduced weight.

The plates are constrained one to each other in such a way to make a space between them adapted to allow the rope passing inside the device.

In the embodiment shown in figures, the plates are constrained in a facing and corresponding position, that is to say in such a way to form two preferably parallel planes, by four spacing pins 4-7, made of metallic material too. As can be seen in FIG. 1, showing a prospective view of the belaying device according to the present invention, the body device is provided with an opening 8 shaped so that to define a specific outline, whereby, as will be better described later on, the device reaches a first non-blocking position of the rope, wherein it is free to run, and a second blocking position of the rope, or emergency position.

The opening outline 8 on both the two plates 2 and 3 is provided with a projecting region, defined by the tooth 20 separating the opening 8 in two subsequent portions 21 and 22, the first distal portion 21 being under the tooth 20 and the second proximal portion 22 over the tooth 20. As shown in FIG. 1, opening 8 has two distinct channels with different shapes that are operably connected. First, opening 8 has a substantially arcuate-shaped channel 8A adjacent to tooth 20 and extends across first distal portion 21 and second proximal portion 22. Second, opening 8 has a second channel 8B within second proximal portion 22 where the channel is above and extends away from tooth 20. Stated otherwise, opening 8 transitions from substantially arcuate-shaped channel 8A to second channel 8B when going from first distal portion 21 to second proximal portion 22. Also shown in FIG. 1, tooth 20 extends into opening 8 and has a top 20A that is substantially orthogonal to a first side 20B and an oppositely positioned second side 20C connecting top 20A to the side of opening 8.

The two plates 2 and 3, constrained one to each other, determine a body 1 of the device that is partially closed along the side surface by a plastic covering portion 9, conveniently shaped to be housed at the side surface of the device body so that to cover the space between the two plates.

As can be seen in FIG. 1, a portion 11 of the side surface of the device is open, for allowing the restraining rope 10 to be inserted into the device body in the space between the two plates 2 and 3.

Figure 2:
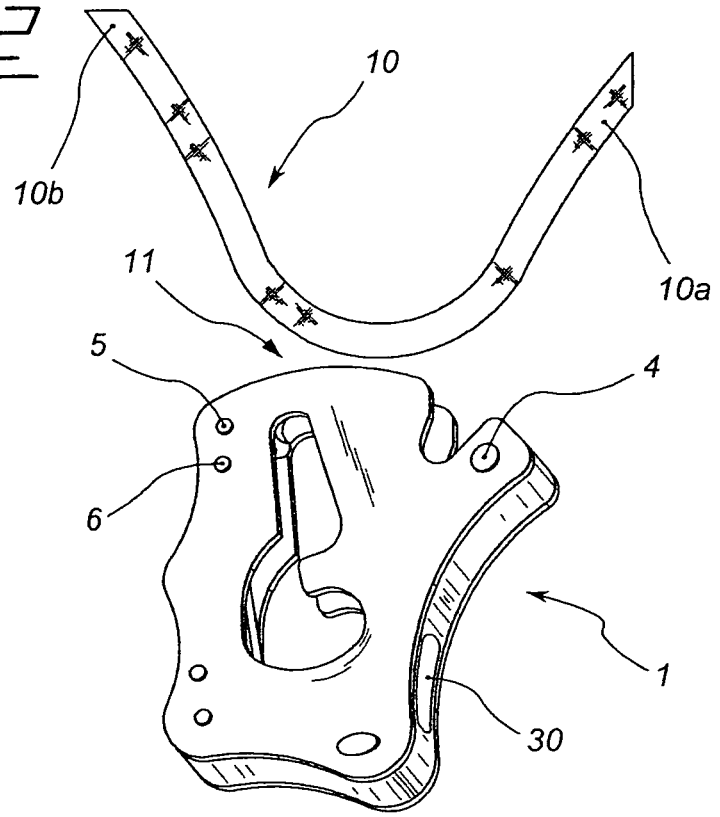
FIG. 2 shows the insertion of the restraining rope inside the belaying device according to the present invention.

The FIG. 2 shows the insertion operation of the rope 10 into the device. Particularly, the restraining rope is "U" folded for the insertion through the open portion 11 of the outer side surface of the device body, until the lower portion of the latter is reached, as can be seen in FIG. 3.

The rope 10 must be correctly inserted into the device, so that the end 10*a*, that is the end passing at the pin 4, is constrained to the climber to be belayed, whereas the end 10*b*, passing at the pins 5 and 6, is corresponding to the free end of the rope running little by little into the device while the climber climbs the wall.

The correct operation of the belaying device according to the present invention provides the use of a carabiner 15, or an equivalent connector, being attached to the device after the restraining rope has been inserted, as described before referring to FIG. 2.

Figure 3:
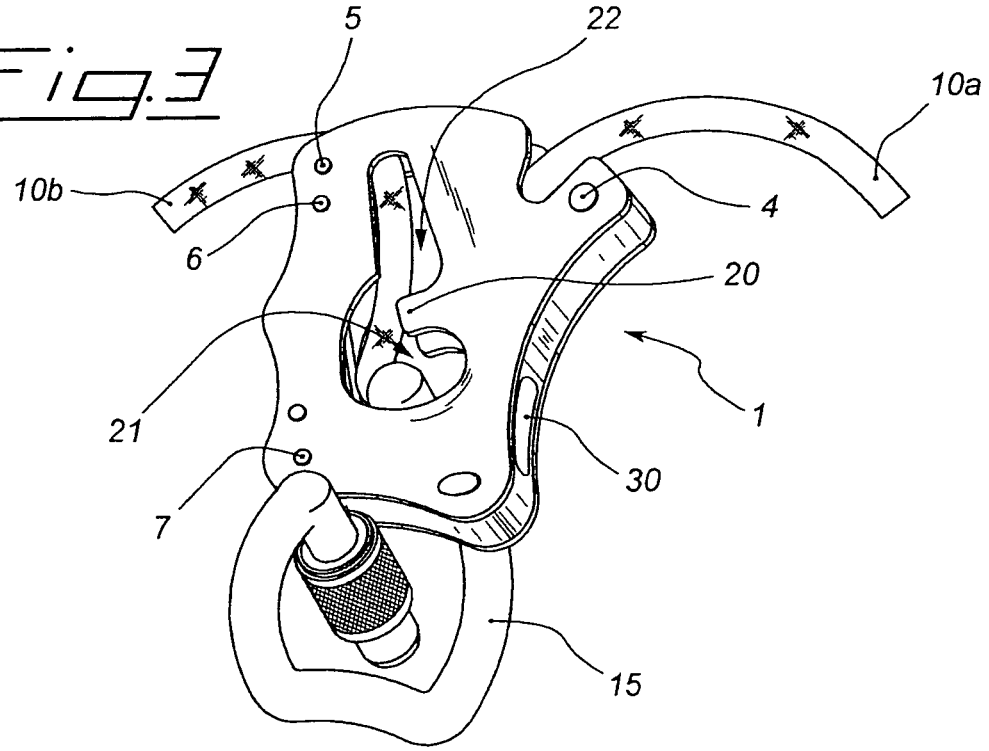
FIG. 3 shows the attachment of the carabiner to the belaying device according to the present invention.

As shown in FIG. 3, the traditional type carabiner 15 is attached to the body 1 of the device passing the open carabiner through both the opening 8 of the device body.

The carabiner 15 exercises the double function of constraining the device to the user (belayer) belaying the second climber in case of fall, in addition to cooperate with the device itself to carry out the rope blocking.

In other words, no further carabiners are necessary, or equivalent means, to constrain the device according to the present invention to the user belaying the companion.

Figure 4:
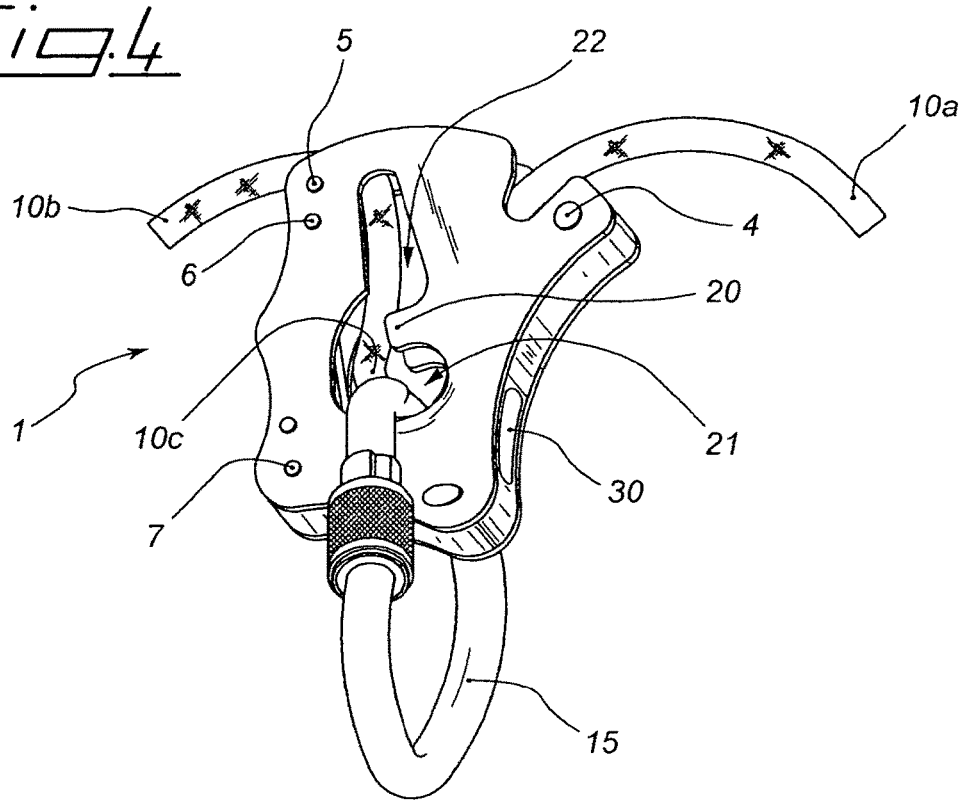
FIG. 4 is a perspective view of the belaying device according to the present invention in a non-blocking position of the restraining rope.

As will be after particularly evident referring to the description of the device operation, the carabiner 15, attached to the device by passing into the opening 8, is mobile inside the opening itself between the first portion 21 and the second portion 22, and vice versa. When the carabiner is in the first portion 21 of the opening 8, position shown in FIG. 4, the device is in the non-blocking position of the rope, that is to say in the normal use position in which the rope is free to run inside the body 2 of the device.

Figure 5:
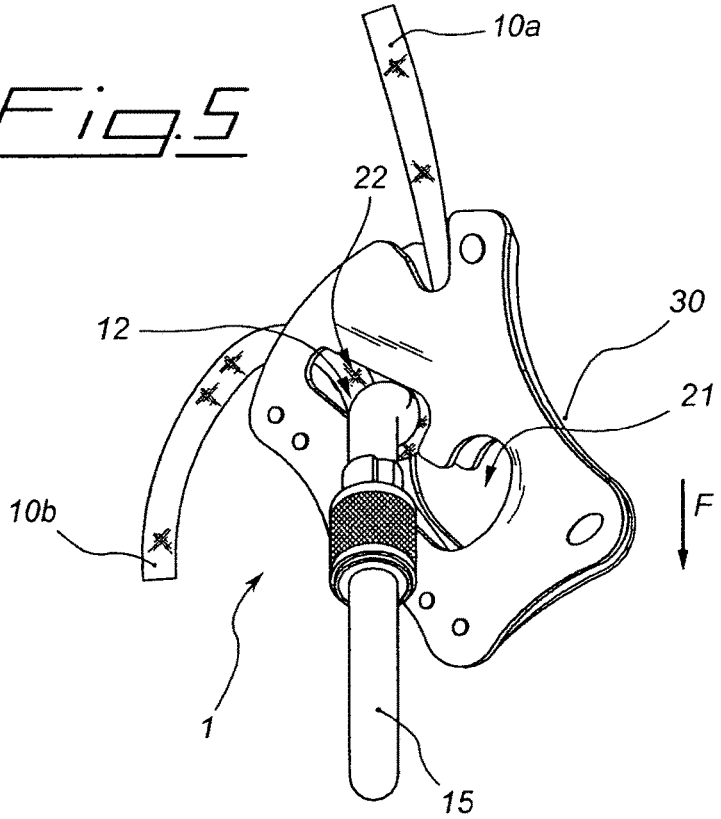
FIG. 5 is a perspective view of the belaying device according to the present invention in an emergency position, or blocking position, of the restraining rope.

When the carabiner is at the second portion 22 of the opening 8, position illustrated in FIG. 5, the device is in the emergency position, and the rope 10 is blocked so that to prevent its running.

The belaying device is of the semiautomatic type only if the user holds in one hand the slack rope, that is the free end of the rope. In case of the belayed climber falls, the user (belayer) holds in one hand the free end of the rope and the carabiner 15 automatically snaps in the blocking position. In fact, in case of fall, the end engaged by the rope 10*a* is subjected to a tension applying a force on the carabiner causing the moving thereof along the opening 8 from the first portion 21 to the second portion 22, wherein the device is in the emergency position and a further running of the rope is avoided.

Inside the body 1 of the belaying device, that is inside the space defined by the two plates 2 and 3, a contrast element 12 and means for preventing the accidental moving of the carabiner 15 from the non-blocking position of the rope to the emergency position, and vice versa, are disposed.

The contrast element 12 is fixedly constrained at the pins 5 and 6 and constitutes the element determining the rope blocking in cooperation with the carabiner 15, when the latter is displaced into the second portion 22 of the opening 8, following the rope tensioning caused by the belayed climber fall and the fact that the user (belayer) has held the free end 10*a* of the rope. As can be seen in FIG. 1, the contrast element 12 is provided with, on its own contact surface with the rope, a V shaped groove 45, or equivalent means, for improving the friction generated on the rope so that to render its blocking more efficient.

As can be seen particularly referring to FIG. 5, when the device is in the blocking position of the rope 10, the latter is sandwiched between the contrast element 12 and the carabiner 15 disposed on the second portion 22 of the opening 8. The running of the rope 10 is blocked because of the friction of the carabiner 15, that is forced against the contrast element 12 under the tension effect of the rope 10.

Means for preventing the accidental movement of the carabiner 15 include the mobile lever 13 rotatably constrained to the end portion of the contrast element 12. More in detail, the lever is constrained to the contrast element 12 by a spring, not shown in figures.

The spring is loaded in such a way to force the mobile lever 13 to dispose in a contrapposed position relatively to the tooth 20 of the opening 8.

In other words, the spring preloading will determine the rotation of the lever 13 in such a way that the latter is disposed towards the central portion of the device.

The lever prevents the carabiner 15 movement from the first portion 21 to the second portion 22 of the opening 8 and vice versa, acting only on the rope, or only on the carabiner too.

In fact, when the device is in the non-blocking position of the rope 10 and the carabiner 15 is in the first portion 21 of the opening 8 (position shown in FIG. 4), the mobile lever 13 is pushing, because of the preloading of the spring, onto the portion of the rope 10*c* and then the carabiner 15, in such a way that the latter will stay under the tooth 20 preventing the movement thereof along the opening 8.

By doing so, the person carrying the constrained device may leave the rope running inside the device without the risk that the carabiner 15 would accidentally move into the second position 22, thereby causing the unwanted reaching of the blocking position of the rope.

The spring preload is such that, in normal use conditions, it is prevented the accidental movement of the carabiner 15.

In emergency conditions, the force exercised by the tensioned rope 10 on the carabiner 15 is able to overcome the contrast offered by the spring preload, moving the mobile lever 13 to allow the movement of the carabiner 15 along the opening 8 until the reaching of the locking position of the rope in the second portion 22 (FIG. 5).

Once the carabiner has reached the second portion 22 for determining the blocking of the rope 10, the mobile lever 13 is free to come back into the position wherein it is contrapposed to the tooth 20 of the opening 8. For this reason, when it is necessary to return the device into the blocking position of the rope, the user will have to manually displace the device body in such a way to move the carabiner 15 along the opening 8 from the first portion 21 to the second portion 22.

For carrying out that operation, such a force will have to be exercised to overcome the spring preload of the mobile lever, in such a way to cause the temporary movement thereof and allow the passing of the carabiner 15 at the tooth 20. Once the carabiner 15 has been returned into the first portion 21 in the non-blocking position of the rope, the lever comes back into the position wherein it is contrapposed to the tooth 20, for preventing the accidental movement of the carabiner into the blocking position, during a new using step.

As afore describe referring to FIGS. 2 and 3, the rope 10 must be inserted correctly inside the device. In case wherein the rope is accidentally inserted in a wrong way, that is to say with the end 10*b* passing at the pins 5 and 6 constrained to the climber to be belayed, and with the end 10*a* free, the belaying device according to the present invention is anyway able to guarantee the blocking of the rope and preventing the belayed climber fall.

In fact, as can be seen in appended figures, the upper portion of the plates 2 and 3, at the pin 4, is shaped in such a way to comprise a groove 50 on each of them, for assuring the rope blocking in case wherein the latter has been inserted in a wrong way inside the device.

In case of fall of the belayed climber, the end 10*b* incorrectly constrained thereto, is tensioned but the device, being used in a wrong way, would not snap in the emergency position, or anyway it is not able to exercise such a friction to allow the rope blocking.

The free end 10*a* of the rope, under the tension effect produced by the falling climber weight, tends to independently dispose, or anyway it is forced by the user belaying the companion to pass inside one of the two grooves 50 allowing to exercise friction on the rope, thereby causing its blocking. The grooves 50 are conveniently shaped in such a way to aid the arrangement in their inside of the end 10*a* of the rope and exercise a sufficient friction to determine the blocking thereof.

It has however to be specified that the grooves 50 guarantee the blocking of the rope in a wrong using condition of the device, that must not be preferred to the illustrated way in the figures wherein the end 10*a* of the rope, passing at the pin 4, is the end constrained to the climber to be belayed.

The operating steps of the belaying device according the present invention will be now described, for purposed of illustrations, in case wherein it is used for belaying the first climber of the roped party. As before mentioned, this technique foresees that a person on the ground, or the climbing wall, having the device constrained by the carabiner 15, would belay the first climber climbing the wall.

First of all, the person on the ground must insert the rope into the device and attach the carabiner 15 by passing it through the opening 8, as afore described referring to FIGS. 2 and 3.

Afterwards, the person on the ground constrains the device on himself in the non-blocking position of the rope by attaching the carabiner 15 to his harness, or a specific belt, normally used in the climbing equipment.

The task of the person on the ground is to leave the restraining rope running little by little inside the device as the climber proceeds in the climbing, that is leaving the free rope 10*b* running inside the device, to provide it to the climber constrained to the end 10*a*.

The person on the ground provides the rope to the climber, using a well known technique, consisting in avoiding to hold in one hand the belaying device, and use the hands for controlling the rope portions upwards and downwards the device, respectively, that is the free end 10*b* and the end occupied 10*a* by the belayed climber.

In case of emergency, that is fall of the belayed climber, the person on the ground holds the slack rope, that is the free end of the rope 10*b*, and the device automatically moves into the blocking position of the rope, by the movement of the device 15 along the opening 8, because of the force given by the tensioned rope to the carabiner itself.

In fact, when the climber looses the handhold and then starts falling, the occupied end of the rope 10*a* is tensioned because of the climber weight. Such a sudden tension increasing of the occupied end will cause the movement of the carabiner 15 along the opening 8 under the effect of the force given by the rope intending to get out from the device.

The force exercised by the rope under tension is such to overcome the contrast force of the spring of the mobile lever 13, allowing the carabiner 15 to pass into the second portion 22 in the blocking position of the rope. Particularly, the rope is sandwiched between the contrast element 12 and the carabiner 15.

By doing so, the rope is firstly blocked because of friction between the contrast element 12 and the carabiner 15.

In the emergency position, for partially releasing the rope, the friction between the carabiner 15 and the contrast element 12 is reduced. For carrying out such an operation, no handles or similar means are provided, as in the traditional devices.

The user acts manually on the device, at the groove 30 obtained into the portion of plastic material 9, moving the body 1 of the device, as indicated by the arrow F in FIG. 5.

It has to be noticed that the groove 30 has to aid the handhold, however, for reducing the friction on the rope when the device is in the blocking position, and then for controlling its running it is sufficient to manually move the device body, substantially in the way shown by the arrow F, or anyway in such a way to limit the friction generated on the rope disposed between the contrast element 12 and the carabiner 15. Manually pushing at the groove 30, substantially the rotation of the device toward the free end of the rope 10*b* is determined (FIG. 5), causing the decreasing of the friction exercised on the rope by the contrast element 12 and the carabiner 15.

The controlled running of the rope when the device is in the blocking position is used, for example, when it is desired to give some rope to the fallen climber that has after newly gripped the handhold, or if the device is used as a descender.

The manual action of the user on the device body, in fact, will cause the movement of the contrast element 12 constrained thereto, relatively to the carabiner 15, on the contrary standing substantially still, being subjected to the rope tension. Then the rotation of the contrast element 12 relatively to the carabiner 15 changes the friction exercised on the rope thereby causing its movement.

According to the movement of the device body made by the user, it is possible to obtain a controlled running of the rope more or less marked.

Obviously, it has to be remembered that according to the present invention it is possible to constrain more devices one to each other, such that they are positioned side by side at one plate.

The invention claimed is:

1. A belaying device for blocking a rope with a carabiner, said belaying device comprising:

a main body formed by a first plate constrained to a second plate, said first and second plates spaced apart defining an interior space extending along a major longitudinal axis of said main body and providing an open portion at one end of said device sized for ingress and egress of said rope being inserted between said first and second plates into said interior space, and said open portion intersecting and directly opening into said interior space, said first and second plates each provided with an opening, said openings directly opening into said interior space thereby directly opening into said open portion and are provided for attaching said carabiner to the main body of the device, said openings being in alignment to each other and adapted to allow said carabiner to be movable along said openings between a non-blocking position allowing movement of said rope and a blocking position inhibiting movement of said rope, wherein during use, said carabiner passes through said openings while said rope passes through said carabiner, and each of said openings having a distal portion distal to said open portion corresponding to said non-blocking position of said device and having a proximal portion proximal to said open portion corresponding to said blocking position of said device, wherein each of said openings, at one side of said openings, has a projecting tooth positioned in alignment to each other, said projecting tooth extending into each of said respective openings thereby separating said distal portion of each of said openings from said proximal portion of each of said openings, said projecting tooth having a top portion, a first side and an oppositely positioned second side, said top portion, said first and said oppositely positioned second side being coplanar to each other, and said first side and said oppositely positioned second side extending from said one side of said openings to said top portion, wherein each of said respective openings include two distinct channels with different shapes, said two distinct channels comprising (i) a substantially arcuate-shaped channel adjacent to said projecting tooth connecting said distal portion to said proximal portion thereby allowing movement of said carabiner between said non-blocking position and said blocking position, and (ii) a second channel extending away from said projecting tooth and towards said open portion; and wherein said substantially arcuate-shaped channel in said proximal portion transitions to said second channel.

2. The device according to claim 1, further comprising a mobile lever in an opposing relationship to and biased towards said projecting tooth disposed in each of said respective openings at a position opposite from said mobile lever, said mobile lever configured to inhibit accidental movement of said carabiner between said distal portion of said openings and said proximal portion of said openings when said carabiner is positioned in either said distal portion of said openings or said proximal portion of said openings.

3. The device according to claim 2, further comprising at least one contrast element between said first and second plates and disposed in said second channel in an opposing relationship to said projecting tooth.

4. The device according to claim 3, wherein said at least one contrast element is provided with a groove.

5. The device according to claim 3, wherein said at least one contrast element is disposed intermediate said first and second plates and adapted to engage said rope.

6. The device according to claim 1, wherein said first and second plates, at a position proximal to said open portion, each have a groove to facilitate blocking of an incorrectly inserted rope, and said groove in each plate being in alignment to each other.

7. The device according to claim 1, wherein said first and second plates define a perimeter, said perimeter including a covering portion disposed intermediate said first and second plates thereby closing off said interior space along said perimeter with an exception of said open portion sized for ingress and egress of said rope.

8. The device according to claim 1, wherein said main body formed by said first and second plates has a top at one end of said device and an oppositely positioned bottom, said top having said open portion located therein.

9. The device according to claim 1, wherein said top portion of said projecting tooth is substantially orthogonal to said first side and said oppositely positioned second side.

10. The device according to claim 1, wherein said open portion is substantially orthogonal to said longitudinal axis.

* * * * *